United States Patent [19]

Bailey

[11] Patent Number: 4,838,436

[45] Date of Patent: Jun. 13, 1989

[54] SELF-ADJUSTING FILE DRAWER FILLERS

[76] Inventor: Dan H. Bailey, P.O. Box 6488, Chico, Calif. 95927

[21] Appl. No.: 215,306

[22] Filed: Jul. 5, 1988

[51] Int. Cl.[4] ..... A47F 7/00

[52] U.S. Cl. ..... 211/51; 211/10

[58] Field of Search ..... 211/51, 10, 11, 59.3, 211/43, 184; 312/190, 183; 206/74; 217/64

[56] References Cited

U.S. PATENT DOCUMENTS

| | | | |
|---|---|---|---|
| 173,453 | 2/1876 | Dorrance | 211/51 |
| 1,121,151 | 12/1914 | Ulrich | 312/190 |
| 1,271,508 | 7/1918 | Hall | 211/51 |
| 1,732,643 | 10/1929 | Dierks | 211/51 X |
| 3,169,654 | 6/1963 | Pollklesener . | |
| 3,248,156 | 4/1966 | Repko | 211/59.3 X |
| 3,389,944 | 6/1968 | Humphrey . | |
| 3,764,019 | 10/1973 | Creamer | 211/51 X |
| 3,860,304 | 1/1975 | Bolton . | |
| 4,588,093 | 5/1986 | Field . | |

*Primary Examiner*—Alvin C. Chin-Shue

*Assistant Examiner*—Sarah A. Lechok Eley

[57] ABSTRACT

Three separate embodiments of file drawer fillers are provided in the invention. One filler is partially self-adjusting and two fillers are completely self-adjusting in length to accommodate variations in the number of documents in a file or desk drawer. A first embodiment is a substantially rectangular panel strip transversely fan-folded to form several connecting smaller panels of equal size. The folds are aligned horizontally with the two end panels positioned vertically to support filed materials in a vertical position. A second embodiment is provided in an elongated enclosed bellows endwardly connected to vertical end panels. The end panels form the document support surface. The bellows portion of the device is affixed with an air valve which allows the release or intake of air to adjust supporting length of the bellows. A third embodiment entails a horizontal compression spring endwardly attached to two vertical end panels with the end panels providing document support surfaces.

8 Claims, 2 Drawing Sheets

SELF-ADJUSTING FILE DRAWER FILLERS

BACKGROUND OF THE INVENTION

1. Field of the Invention

This invention relates to devices for supporting folders, envelopes and the like in the drawers of filing cabinets. More precisely, my invention provides three embodiments of self-adjusting file supports, two of which are completely self-adjusting and one which requires minor manual adjustments, both designed for adjustable horizontal bracing and support of one or more documents in drawers of filing cabinets.

2. Description of the Prior Art

Several devices are currently available on the market as drawer fillers which are designed to hold documents in a substantially upright position when the drawer is less than full, however, the majority of these are provided as manual adjusting units sold as an inherent portion of the filing cabinet itself. Not only are they not self-adjusting but they are usually expensive to purchase and assemble as a separate unit. Therefore, a search was conducted in the following classes and subclasses to produce individual file drawer fillers which are partially or completely self-adjusting:

312/283, 190, 191, 61, 221/57, 58, 54, 211/51, 58, 59, and 267/165.

The patents which were noted as being most pertinent to my invention are as follows:

1. Pollklesener was issued U.S. Pat. No. 3,169,654, of Feb. 16, 1965, for a "Receptacle Closure Comprising A Resilient Spacer", designed primarily for pharmaceutical bottles containing bolus medications for preventing vibration of the bottle contents.

2. A patent issued to Humphrey on June 25, 1968, U.S. Pat. No. 3,389,944, illustrates a portion of one embodiment as a fan fold type filing folder which is designed to hold documents within the folds of the device and must be used in conjunction with a specific filing system using movable, cantilevering arms.

3. On Jan. 14, 1975, Bolten was issued U.S. Pat. No. 3,860,304, for a coiled spring dispensing container.

4. U.S. Pat. No. 4,588,093, was granted to Field on May 13, 1986, for a self-adjusting fan-fold type merchandise display device.

The past art patent most relevant to my invention appears to be U.S. Pat. No. 3,389,944, which discloses a portion of the preferred embodiment as a fan-folded cardboard or fiberboard unit designed to hold letters, folders or the like within the folds of the unit itself. Each end has short flanges which are devised to retain the unit on movable horizontal cantilever arms. The first embodiment of my invention, although similar in appearance due to the fan fold design, is not structured to hold envelopes or papers within the folds of the device but to be a support bracing positioned behind them. My device is specifically designed to provide an outward exerting force which is structured to support the envelopes and folders in a substantially vertical position and to be self-adjusting by compressing and reducing in size when additional envelopes or folders are added to the drawer. No claim is made on the Humphrey device for this feature nor is there any mention of it being anticipated in the future.

The second past art device most pertinent to mine is U.S. Pat. No. 4,588,093, which depicts a narrow fan-fold spring device attached to an L-shaped bracket for purposes of displaying merchandise. Each fold of the fan-fold section is affixed with a wire spring which provides added biasing force. The first embodiment of my invention eliminates the need for this wire spring for attachment to a support bracket. Not only is the Field device more expensive to produce than mine, having these extra elements, it requires assembly which again increases costs. The L-shaped bracket must also be positioned in a specific direction, against the documents, where as my device is equally functional utilizing either end panel as the document support surface. There also arises some question as to the probable tendency for the L-shaped support bracket to buckle under pressure especially when supporting folders or envelopes much wider than the L-shaped support bracket such as legal sized documents. For large file folders, two of the Field devices could be utilized to solve the problem, but then the cost is again increased. Field makes no claim that his device is compatible with varying dimensions of different documents such as legal papers or smaller items like index or business cards.

The Pollklesener U.S. Pat. No. 3,169,654, shows a closure device for bottles which reduces vibration and damage to the contents, particularly with pharmaceutical goods. Some similarity exists between this past art patented device and the second embodiment of my invention. My device, however, comprises an air tight unit having a collapsible accordion style bellows with an air release valve, and by bellows are attached to two flat vertical end panels used as bracing surfaces. The Pollklesener device is designed as a closure or cap, and contains threads for engagement to a container which is not the intention or aim of my invention. The accordion section of the Pollklesener device is also not designed to be air tight nor does it have an air valve for regulating the amount of air containment.

The Bolten U.S. Pat. No. 3,860,304, has a compression spring dispensing device which is specifically designed for the disclosed container. The compression spring, having only one support panel, is permanently attached to the interior wall of the container, whereas my device, having two support panels, is specifically designed not to be attached to any surface. Nowhere in the specification or claims has Bolten anticipated his spring unit being provided as a separate item, or for the use of supporting documents in filing cabinets. The similarity between my device and that of Bolten's is use of a compression spring. However, many other unrelated devices also use compression springs and my use of the compression spring is significantly different from the use in the Bolten device.

To the best of my knowledge, the devices disclosed in the past art patents cited represented those most pertinent to my invention. A file drawer filler illustrating the advantages of my invention was not seen in the devices which I have specifically compared with each of my separate embodiments.

SUMMARY OF THE INVENTION

In practicing my invention, I have provided three separate embodiments of file supports for conventional filing cabinets, desk drawers, and portable cardboard filing systems. Smaller versions of all embodiments are applicable for use with smaller documents such as recipe cards and business cards.

The first embodiment of the invention is a simple collapsible fan-folded device which can be manufactured of cardboard, plastic or metal. The height of the device, except for sizes supplied as smaller card supports, is approximately eight inches whereas the width varies from just under eleven inches for regular paper length to approximately fourteen inches for legal sized documents. The degree of outward pressure exerted increases as the device is compressed by weight of added folders and envelopes. The increased pressure is necessary to support the added weight.

The second embodiment of the invention is provided in an air tight accordion style bellows structure which is endwardly attached to two vertical rectangular panels. This unit can be manufactured of plastic or any durable canvas type material which is air tight. The variations provided in size are the same as those provided in the first embodiment. The collapsible bellows section contains an air valve with cap which allows the release of air when the cap is removed and the unit compressed, and also allows for the introduction of air when the unit is expanded. The two end panels can be pulled in opposite directions which cause air to be drawn in through the open valve, eliminating the need for a pump to introduce air into the device. Once filled with air, the unit is still compressible to a certain degree, depending upon the force exerted against the end panels, making the device partially adjustable for accommodating additional documents. Removing the valve cap and releasing air will further reduce the size of the device thereby providing a manual adjustment means.

The third embodiment of the invention provides a drawer filler structured of one large metal or plastic compression spring positioned horizontally and endwardly attached to two vertical rectangular end panels. The end panels can be manufactured of cardboard, plastic wood or metal. The spring in this embodiment exerts an increase in outward pressure as it is compressed to support added weight of additional files in a file drawer.

Therefore, it is a primary object of my invention to provide a file drawer filler which supports documents in a substantially upright position and which is horizontally self-adjusting to accommodate for variations in the number of documents.

Another object of my invention is to provide a file drawer filler which is cost effective to produce and simple and easy to use being horizontally reversible and also self-contained, requiring no assembly or attachment to the filing cabinet or drawer structure.

A further object of my invention is to provide a file drawer filler which can accommodate documents in drawers in both legal sizes and letter sizes and is adaptable for smaller items such as recipe cards, index cards and business cards.

A still further object of my invention is to provide a file filler which is duly suited, in size shape and cost, for portable cardboard storage boxes and cardboard filing cabinets.

Other objects and the many advantages of my invention will become known from a reading of the specification and subsequent comparison of the numbered parts described with similarly numbered parts illustrated in the drawings.

DRAWING REFERENCE NUMBERS

Figure 1:
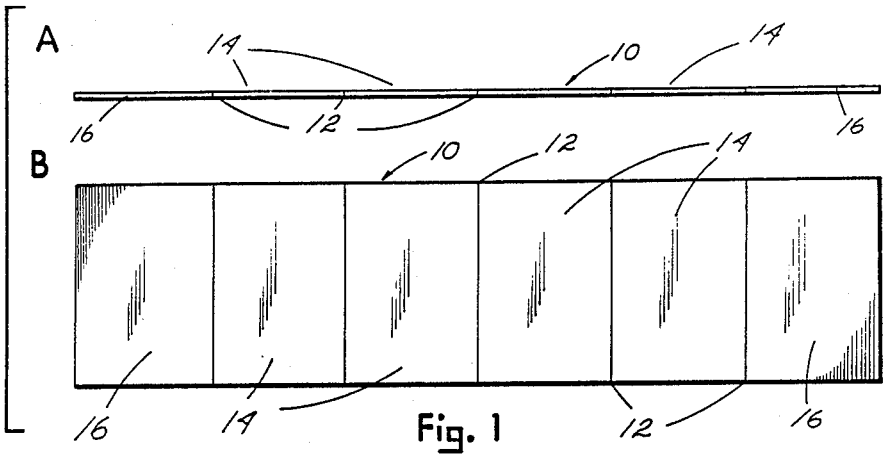
FIG. 1 shows the pleated first embodiment of the invention, where A is a side view and B is a front or back view, both being the same.

10 pleated embodiment
12 folds
14 interior panels
16 end panels
18 documents
20 drawer
22 accordion embodiment
24 bellows
26 pleats
28 air valve
30 stem
32 cap
34 spring embodiment
36 compression spring

DESCRIPTION OF THE PREFERRED EMBODIMENTS

Figure 2:
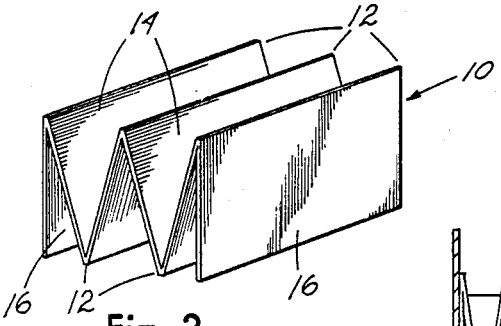
FIG. 2 is a perspective view of the pleated first embodiment illustrating the pleated or fan-fold design.
Figure 3:
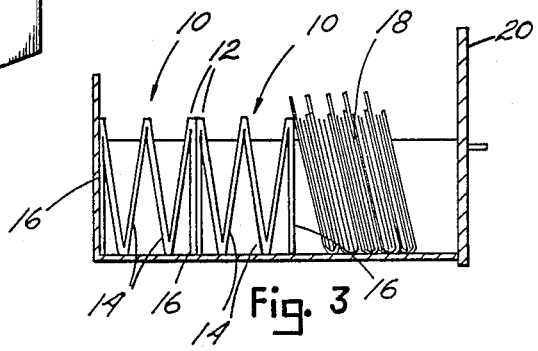
FIG. 3 shows the pleated embodiment in use supporting folders in the drawer of a filing cabinet.

Referring now to the drawings and to FIG. 1 where the pleated first embodiment is illustrated. Pleated embodiment 10 is structured in the form of a thin horizontally oriented rectangular pleated or fan-folded panel manufactured of cardboard, plastic or metal, as seen in FIG. 1, 2, and 3. For illustration purposes only, pleated embodiment 10 is shown having five transverse folds 12 and four interior panels 14 with two vertical end panels 16 all of equal size, however, the number of folds 12 and interior panels 14 may vary. Pleated embodiment 10 is positioned in drawer 20 with end panels 16 vertically oriented and folds 12 positioned horizontally. End panels 16 can be positioned either parellel to or perpendicular to the side walls of drawer 20, depending on user preference. Either end panel 16 can be used to provide the support surface for documents 18, as seen in FIG. 3, which makes the unit substantially reversible, as are all the embodiments. Various sizes of the device are provided to accommodate standard and legal documents 18 as well as recipe, index, and business cards., Two or more pleated embodiments 10 can be used together if necessary, as seen in FIG. 3, to support exceptionally heavy documents 18 or for use in an unusually long drawer 20.

Figure 4:
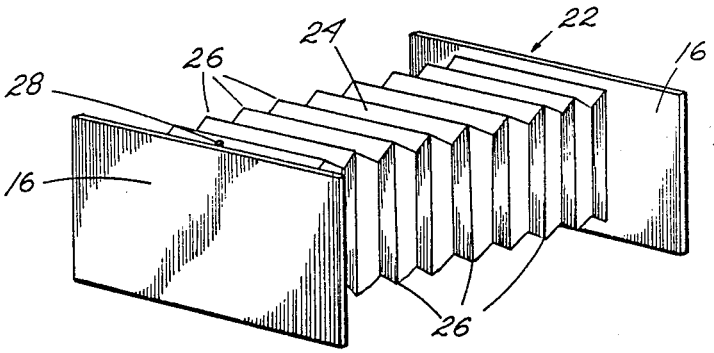
FIG. 4 is a perspective view of the second embodiment illustrating the accordion style bellows.
Figure 5:
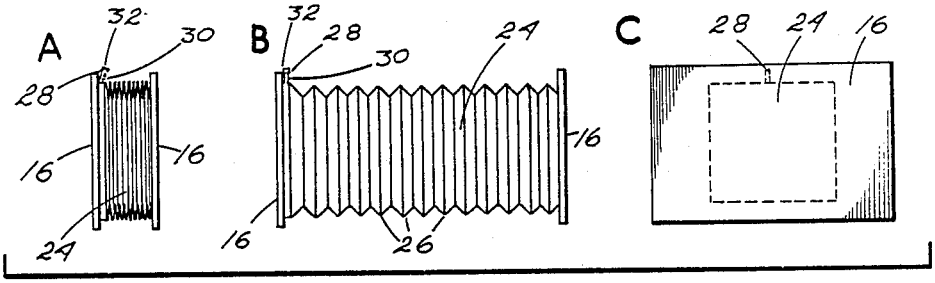
FIG. 5 A is a side view of the accordion embodiment in the compressed state, B is a side view in the expanded state, and C is a frontal view.
Figure 6:
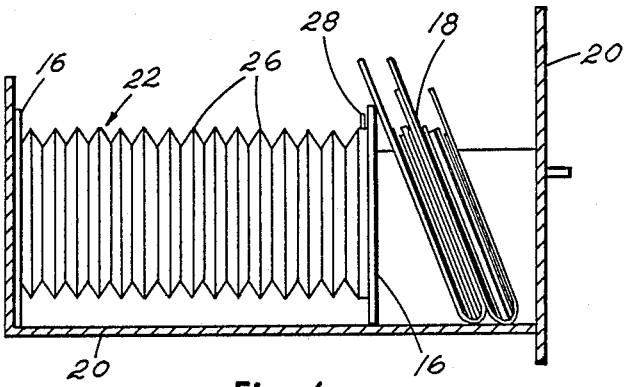
FIG. 6 is a side veiw of the accordion embodiment in use supporting folders in a filing cabinet drawer.

The second embodiment of the invention designated accordion embodiment 22 is shown in FIG. 4, 5, and 6. This embodiment inclues an elongated accordion-like airtight main body or housing comprised of bellows 24. Bellows 24 is a substantially rectangular hollow housing having two closed end sections and is manufactured of plastic or canvas material treated to make the unit airtight. Although bellows 24 is illustrated in the drawings as being rectangular in shape, other suitable shapes and forms such as cylinders can be used. The outer walls of bellows 24 contain pleats 26 which allow the unit to collapse or expand creating variations of air volume within bellows 24. Each enclosed end of bellows 24 is affixed with one vertical end panel 16 which provide the support surface for documents 18. Each end panel 16 of accordion embodiment 22 is a substantially rectangular thin panel having a front and back surface and four narrow sides. Accordion embodiments 22 is provided in various sizes to accommodate regular and legal sized documents 18 as well as the other previously mentioned smaller sizes. Air valve 28 is positioned adjacent one end panel 16 on bellows 23 and contains stem 30 and cap 32. Air is drawn into bellows 24 through stem 30 by pulling end panels 16 outward expanding bellows 24. The air contained within the interior of bellows 24 provides a rigid support for accordion embodiment 22. The amount of air contained within bellows 24 determines how rigid and how long accordion embodiment 22 will be. Unless bellows 24 is completely expanded and air is introduced into air valve 28 by force, such as with a pump, accordion embodiment 22 will still be resilient and compressible to a certain degree. This provides partial adjustability to accommodate more documents 18 added into drawer 20. When additional space in drawer 20 is required, cap 32 is removed from stem 30 and air is released while end panels 16 are compressed together until the desired space is provided in drawer 20.

Figure 7:
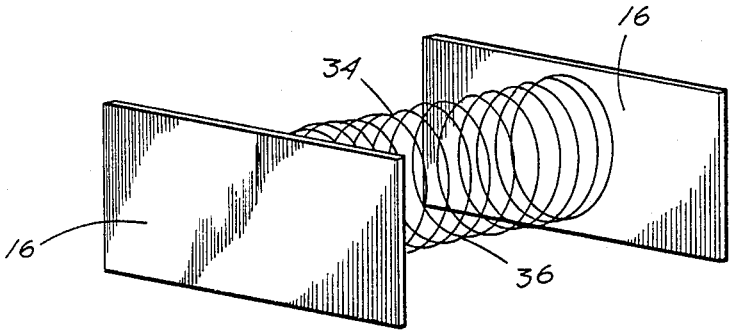
FIG. 7 is a perspective view illustrating the coiled compression spring third embodiment.

The third embodiment of the invention is provided in spring embodiment 34, shown in FIG. 7. Compression spring 36 is horizontally oriented in use and is endwardly, perpendicularly attached to two vertical end panels 16, all of which can be manufactured of cardboard, plastic, metal or a combination of the three. Compression spring 36 comprises the main center body of the device and provides the adjustable means regulating the distance between each end panel 16. The force exerted by compression spring 36 is increased as it is compressed, which therefore automatically adjusts to the added weight of extra documents 18 added into drawer 20. For example, the greater number of documents 18 added to drawer 20 the more spring embodiment 34 is compressed to allow for the extra space needed for those extra documents 18. At the same time compression spring 36 also exerts a greater outward force, the more it is compressed, against those extra documents 18 which is necessary to support the added weight. The end panels 16 of spring embodiment 34 are substantially rectangular thin panels having a front and back surface and four narrow sides. Spring embodiments 34 is provided in various sizes to accommodate regular and legal sized documents 18, index cards, and other small sized filing materials.

All embodiments of the invention can be used together in two or more units to provide extra support when needed for unusually long drawers or exceptionally heavy documents 18. All three embodiments are of a simple design and can be manufactured in only a few segments, which helps to reduce the cost. For use in drawer 20, no assembly or attachment is required. This is a significant advantage over other file drawer fillers requiring additional tools to install the device. Damage which often occurs to drawer 20 at the time of installation due to bolt or screw apertures is eliminated. The present invention is also designed to be used in cardboard filing boxes or cabinets commonly used for saving business records and for household record keeping. When there are only a few documents 18 in drawer 20 they tend to slip down and lay flat on the bottom of the box which makes filing less convenient. The embodiments of the present invention are designed to hold filed documents 18 in an upright position. The devices of the present invention are cost effective, particularly pleated embodiment 10 which can be manufactured sufficiently inexpensively for use in cardboard filing and storage boxes.

Although I have described my invention in detail in the specification, it is to be understood that modifications in the structure and design of the invention may be practiced which do not exceed the intended scope of the appended claims.

What I claim as my invention is:

1. A self-adjusting file drawer filler for supporting documents in a substantially vertical position, comprising:

a. a thin-walled strip formed by folds into step-like panel segments hingedly attached edge to edge producing a substantially rectangular pleated panel structure with said folds transversely positioned; said folds forming at least six equally sized said panel segments with the first said panel segment and the last said panel segment forming vertical end panels; said pleated panel structure arranged for placement in said file drawer with said panel segments angled in said file drawer and said folds, the transversed edges thereof, substantially horizontally aligned with one of said end panels positioned towards a back wall or a side wall of said file drawer and the other of said end panels positioned towards filed materials as a vertical support therefor;

b. a self-adjustment means.

2. The self-adjusting file drawer filler of claim 1 wherein said self-adjustment means is provided by flexibility and resilience in the materials to produce spring-like action in said folds.

3. The self-adjusting file drawer filler of claim 1 wherein materials of manufacture include cardboard, plastic, and metal.

4. The self-adjusting file drawer filler of claim 1 wherein said pleated panel structure is variably sized to fit a variety of file drawers and accommodate different sized file folders and documents including index cards, business cards, standard and legal size papers.

5. A self-adjusting file drawer filler for supporting documents in a substantially vertical position, comprising:

a. an enclosed bellows; said bellows forming an elongated box-shaped accordion-like airtight housing with said bellows having two closed ends each affixed with a flat end panel; said bellows structured for placement in said file drawer longitudinally horizontally inclined with one said end panel towards the rear wall or a side wall of said file drawer and the other said end panel positioned against filed materials as a vertically inclined support therefor;

b. an air valve for inflating and deflating said bellows with said air valve comprised of one stem and one removable cap with said valve attached to said bellows adjacent one said end panel.

6. The self-adjusting file drawer filler of claim 5 wherein said bellows are manufactured of airtight materials including plastic, canvas, rubberized fabrics, and other airtight fabric.

7. The self-adjusting file drawer filler of claim 5 wherein said end panels are manufactured of suitable materials with suitable materials including wood, plastic, cardboard, and metal.

8. The self-adjusting file drawer filler of claim 5 wherein said bellows are formed in a variety of shapes including rectangles, triangles, and cylindericals.

* * * * *